US006065156A

United States Patent [19]

Murphy

[11] Patent Number: 6,065,156

[45] Date of Patent: May 23, 2000

[54] SCARF WITH A KNOT PLEAT

[76] Inventor: Paula C. Murphy, 2984 Dragana Dr., Richmond, Va. 23233

[21] Appl. No.: 08/855,345

[22] Filed: May 13, 1997

[51] Int. Cl.[7] ..... A42B 5/00

[52] U.S. Cl. ..... 2/207; 2/171

[58] Field of Search ..... 2/207, 171, 174, 2/91, 206, 48, 49.1, 88, 133, 131, 243.1, 144, 146, 279, 129, 203

[56] References Cited

U.S. PATENT DOCUMENTS

| | | | |
|---|---|---|---|
| 1,990,167 | 2/1935 | Cloke | 2/146 |
| 2,413,319 | 12/1946 | Golfieri . | |
| 3,286,276 | 11/1966 | Calisch . | |
| 3,380,076 | 4/1968 | Held . | |
| 3,587,114 | 6/1971 | McCourtie . | |
| 3,914,797 | 10/1975 | Stembridge . | |
| 3,935,597 | 2/1976 | Frechmann et al. | 2/207 |
| 4,321,709 | 3/1982 | Steinberg . | |
| 4,404,688 | 9/1983 | Knight . | |
| 4,788,722 | 12/1988 | Oliver | 2/207 |
| 4,790,035 | 12/1988 | Whyte | 2/207 |
| 4,870,707 | 10/1989 | Hayes . | |
| 4,942,627 | 7/1990 | Copprue . | |

*Primary Examiner*—Gloria M. Hale
*Attorney, Agent, or Firm*—J. Michael Martinez de Andino; McGuire Woods Battle & Booth LLP

[57] ABSTRACT

A scarf having a knot pleat that is formed in the scarf between the center of the scarf and one end of the scarf for providing a quick and simple way to tie or secure the scarf to the user. The knot pleat in the scarf is formed by folding the fabric of the scarf and tacking with a straight sewn stitch a machine tack that is generally applied in the middle of the folded fabric. When worn, the unpleated end of the scarf is pulled to the knot pleat thereby securing the scarf to the user.

10 Claims, 6 Drawing Sheets

SCARF WITH A KNOT PLEAT

FIELD OF THE INVENTION

This invention relates in general to apparel and, more specifically, to a scarf having a knot pleat that can be worn around the neck, waist or head of the user.

BACKGROUND INFORMATION

Conventional scarfs, such as those in U.S. Pat. Nos. 4,942,627; 4,870,707 and 3,914,797, have disclosed different ways to tie a scarf around the neck, head or waist of the user. For example, the scarf in U.S. Pat. No. 4,942,627 has a loop formed at the free end of the rectangular portion of the scarf. The user can then pull one of the free remaining corners of the opposite end of the scarf through the loop for securing the scarf to the user.

The scarf in U.S. Pat. No. 4,870,707 has a generally butterfly-like configuration with a center neck portion located between two side panels. The center neck portion has laterally extending pleats stitched in the center neck portion to form a slope along the upper edges of the side panels. When the 707 Patent scarf is worn, the center neck portion is looped around the back of the neck of the user with the side panels being placed on the front of the user. The 707 Patent scarf can have a knot or tie formed in the front of the user by looping or tying one of the ends of each the side panels together.

The scarf in U.S. Pat. No. 3,914,797 has snaps placed in the neck section of the scarf that when fastened together the snaps form a continuous pleat that are designed to hold the neck section folded upon itself. The end sections of the 797 Patent scarf are then allowed to hang naturally about the front of the user.

Additionally, there are other scarfs, such as the scarf in U.S. Pat. No. 3,587,114 that has an opening or hole formed at one end of the scarf which is used for tying the ends of the scarf together. Further, the scarf in U.S. Pat. No. 4,404,688 has a teardrop opening formed in the center that is used to form a collar around the user, with the ends then looped or tied around the neck of the user.

These above-mentioned conventional scarfs encounter several problems such as requiring the use of snaps, holes, loops or the ends of the scarf to tie, secure or attach the scarf to the user. The use of snaps, holes or loops require or use additional material when forming a means for securing the scarf to the user. Moreover, the above-mentioned scarfs do not have a knot pleat formed between the center and one end of the scarf for providing a quick and simple way to tie or secure the scarf to the user.

In order to overcome the above-mentioned defects in scarfs, there is a need for an improved scarf that has a pleat formed in the scarf that does not require the use of snaps, loops or holes, and which does not require the use of additional material to tie or secure the scarf to the user. There is also a need for an improved scarf that includes a knot pleat formed in the scarf between the center and one end of the scarf for providing a quick and simple way to tie or secure the scarf to the user.

SUMMARY OF THE PRESENT INVENTION

Accordingly, it is the primary object of the present invention to provide a scarf that has a knot pleat formed in the scarf that allows a user to pull the unpleated end of the scarf through the pleat for securing the scarf to the user.

It is a further object of this invention to provide a scarf that has a knot pleat formed between the center and one end of the scarf that allows a user to pull an unpleated end of the scarf through the pleat for securing the scarf to the user.

It is another object of this invention to provide an scarf with the foregoing advantages that can be manufactured with an economic use of fabric, materials and labor. Other objects and advantages of this invention will become apparent from the following description taken in connection with the accompanying drawings wherein are set forth, by way of illustration and example, certain embodiments of this invention.

DETAILED DESCRIPTION OF THE PREFERRED EMBODIMENTS OF THE INVENTION

Before the present scarf with a knot pleat is described, it is to be understood that this invention is not limited to a particular scarf, as such may, of course, vary. It is also to be understood that the terminology used herein is for the purpose of describing particular embodiments only, and is not intended to be limiting as the scope of the present invention will be limited only by the appended claims.

Figure 1:
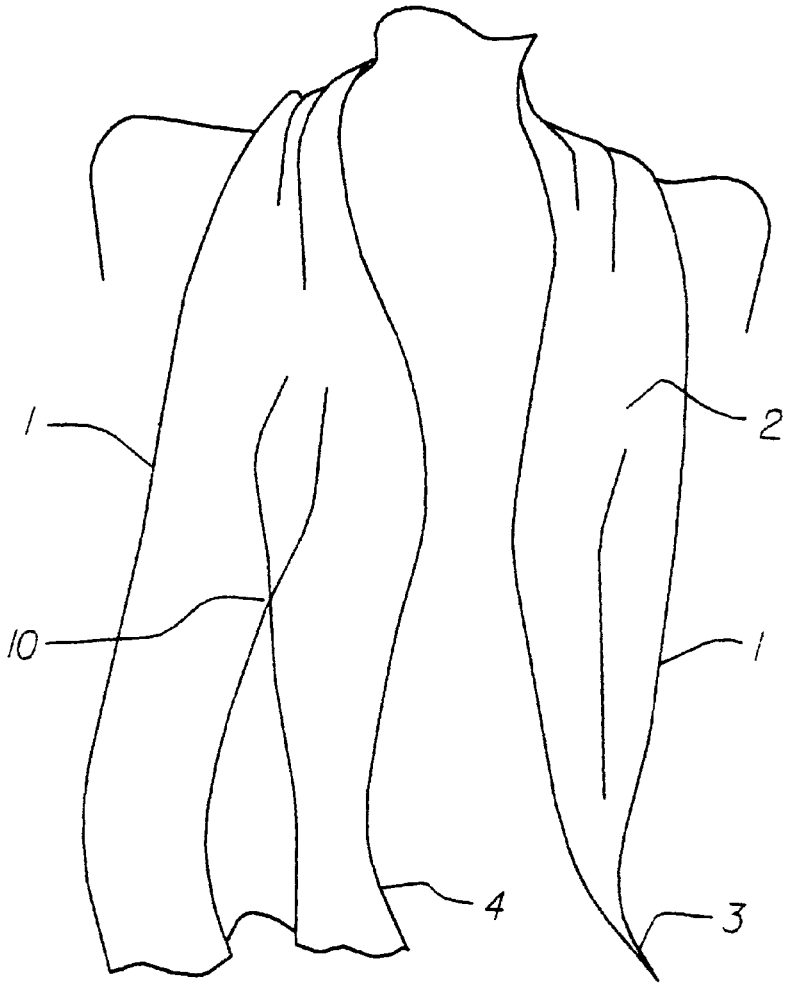
FIG. 1 is a perspective view of a typical embodiment of a scarf having a knot pleat with scarf being placed about the neck of a user.
Figure 2A:
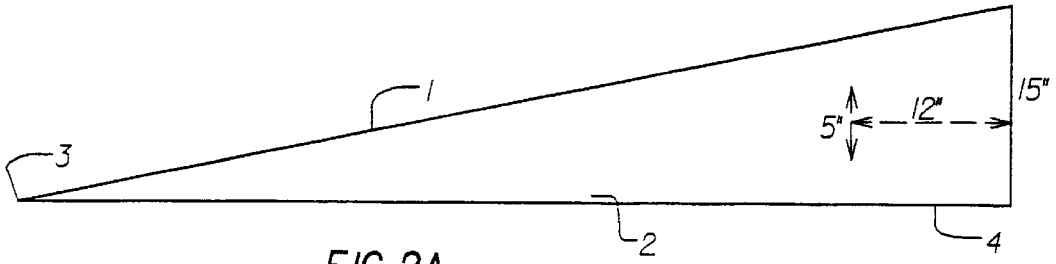
FIGS. 2A–2D are top plan views of a right angle triangular shaped scarf showing the placement of a knot pleat for securing the scarf about the neck of a user.
Figure 2B:
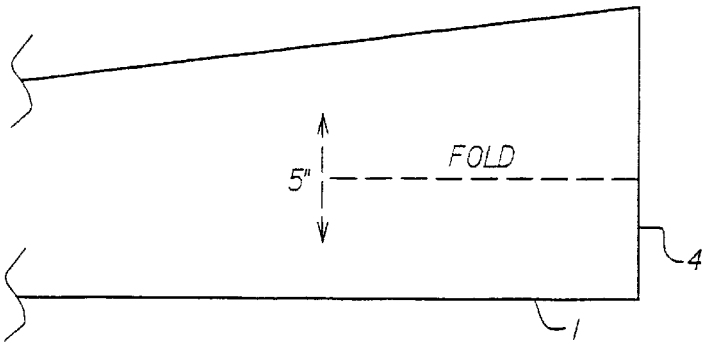
Figure 2C:
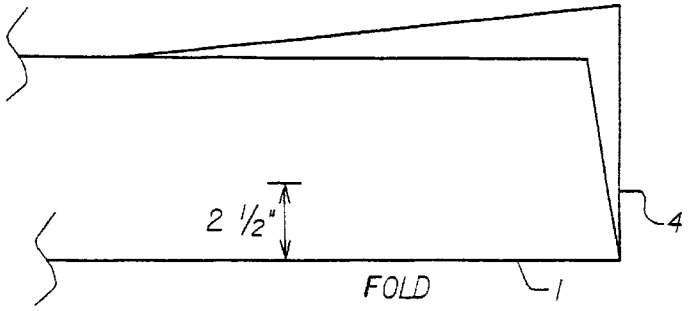
Figure 2D:
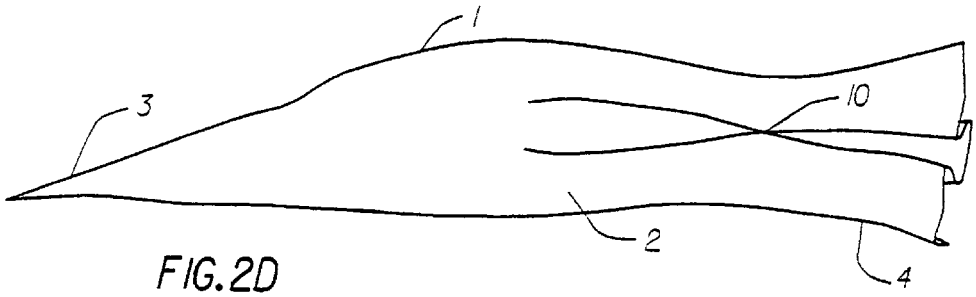

Unless defined otherwise, all terms used herein have the same meaning as commonly understood by one of ordinary skill in the art to which this invention belongs. Referring now to the drawings, a typical embodiment of the scarf with a pleat is shown in FIG. 1. The scarf is generally designated by the reference numeral 1 and can be made of different types of fabrics, including but not limited to any and all natural or man-made fibers, such as wool, cotton, nylon, silk or a combination of the above, and can have any variation of color(s).

Figure 3:
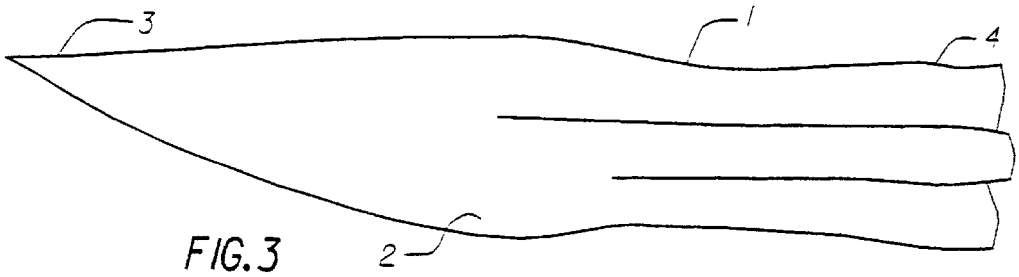
FIG. 3 is a bottom plan view of the right angle triangular shaped scarf shown in FIG. 2.

As shown in FIGS. 1–3, the scarf 1 has a scarf body 2 which has a first end 3 that is spaced apart from a second end 4. The scarf 1 is approximately 63 inches long and approximately 15 inches wide at the second end 4. The scarf 1 has a knot pleat 10 that is formed in the scarf body 2 approximately 12 inches from the second end 4 or approximately to ⅕ to ⅓ of the overall length of the scarf 1 from the second end 4. The knot pleat 10 is formed by folding the fabric and tacking with a straight sewn stitch a ⅜ inch machine tack. The stitching is generally applied in the middle of the folded fabric.

Figure 4:
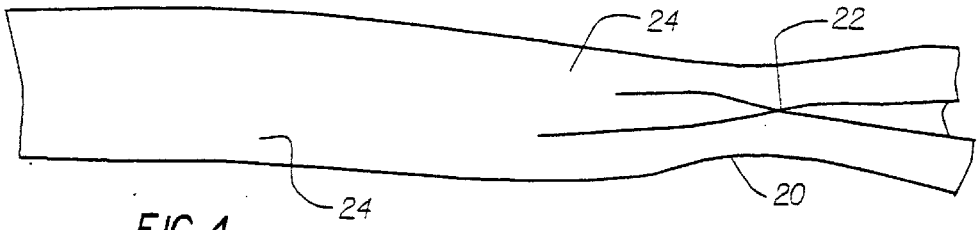
FIG. 4 is a top plan view of a rectangular shaped scarf having a knot pleat for securing the scarf about the neck of a user.
Figure 5:
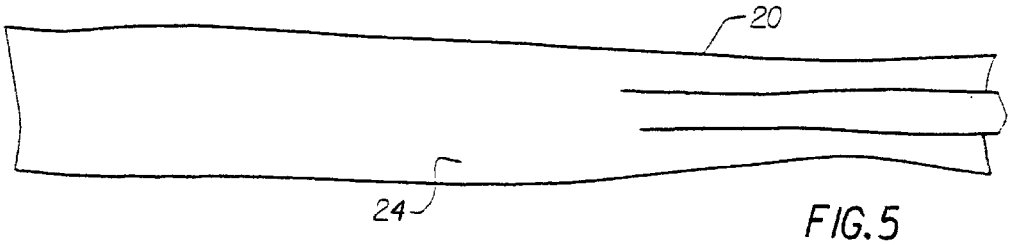
FIG. 5 is a bottom plan view of the rectangular shaped scarf shown in FIG. 4.
Figure 6:
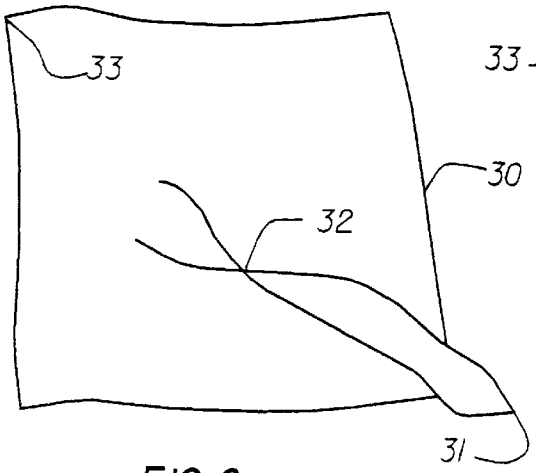
FIG. 6 is a top plan view of a square shaped scarf having a knot pleat for securing the scarf about the neck of a user.
Figure 7:
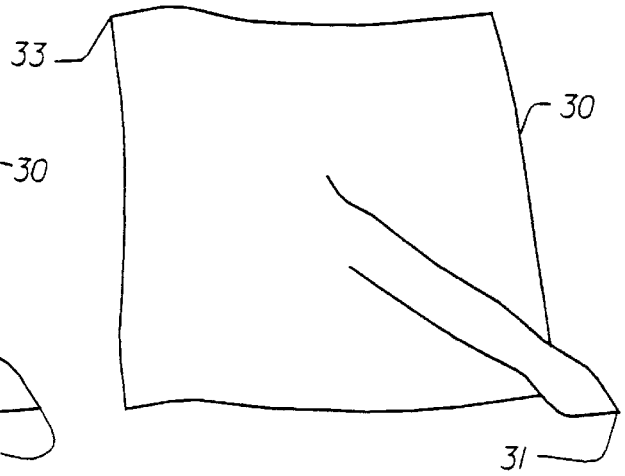
FIG. 7 is a bottom plan view of the square shaped scarf shown in FIG. 6.

An alternate embodiment of the present invention is directed toward a scarf 20 that has a rectangular shape, as shown in FIGS. 4 and 5. The scarf 20 is approximately 33 inches long and approximately 9½ to 10 inches wide. The scarf 20 has a knot pleat 22 that is formed in the scarf body 24 approximately 6½ to 7 inches from one end of the rectangular shaped scarf 20 or approximately ⅕ to ⅓ of the overall length from one end of the rectangular shaped scarf 20. The knot pleat 22 is formed by folding the fabric and tacking with a straight sewn stitch a ⅜ inch machine tack that is generally applied in the middle of the folded fabric. As shown in FIGS. 6 and 7, an additional alternate embodiment of the present invention is shown being directed toward a scarf 30 that is square shaped.

Figure 8:
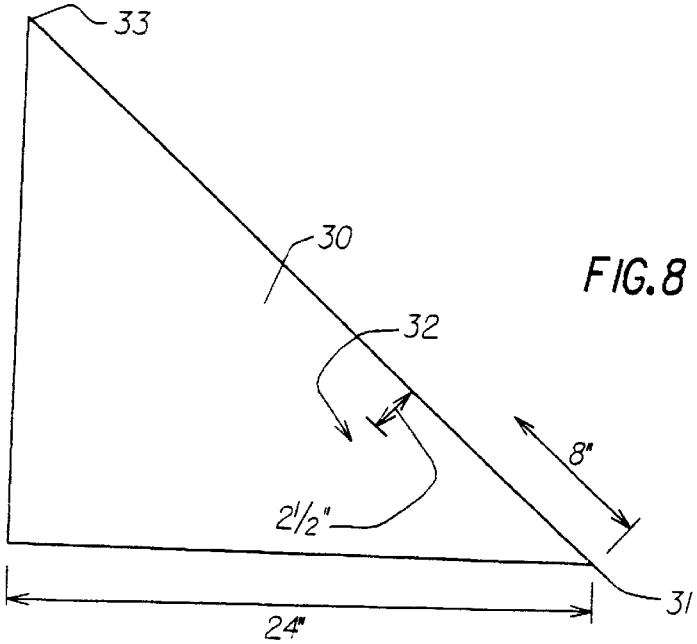
FIG. 8 is a top plan view of the square shaped scarf shown in FIG. 6 which has been folded for forming a pleat in the scarf.
Figure 9:
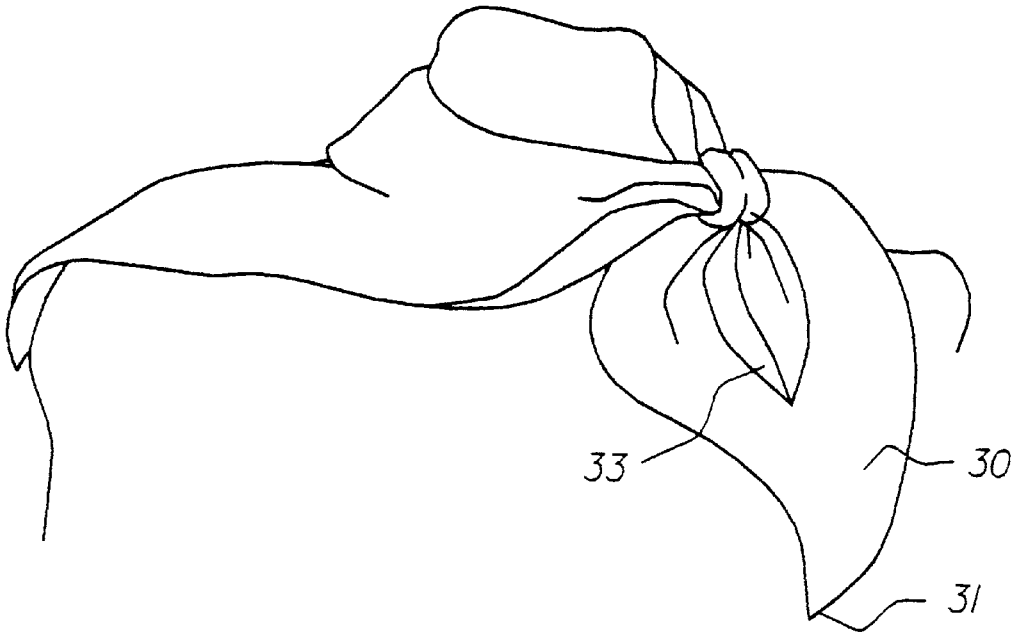
FIG. 9 is a front elevational view of the square shaped scarf shown in FIGS. 6 and 7 about the neck of a user and having the non-pleated end pulled through the knot pleat and looped about the knot pleat for securing the scarf to the user and for forming a decorative tie.

The scarf 30 is approximately a 24 inch square that when folded on the diagonal a tack or a knot pleat 32 can be formed approximately one-quarter of the distance from the first corner 31 or, in this case, approximately 8 inches from the first corner 31. As shown in FIG. 8, the knot pleat 32 is sewn through a straight sewn stitch having a ⅜ inch machine tack that is generally applied approximately 2½ inches from the fold. To wear the scarf 30, the scarf is unfolded and then re-folded with the knot pleat 32 now being exposed. The unpleated end 33 is simply slipped or pulled through the pleat 32 as shown in FIG. 9. The unpleated end 33 than can be slipped through the knot pleat 32 once or twice and draped to form a knot or a bow effect.

The above-mentioned scarfs 10, 20 and 30 can be constructed of a single layer of fabric and the edges being finished with a rolled hem. Alternatively, the above-mentioned scarfs can be formed of a double layer of fabric that are sewn together at the edges using a rolled hem.

Figure 10A:
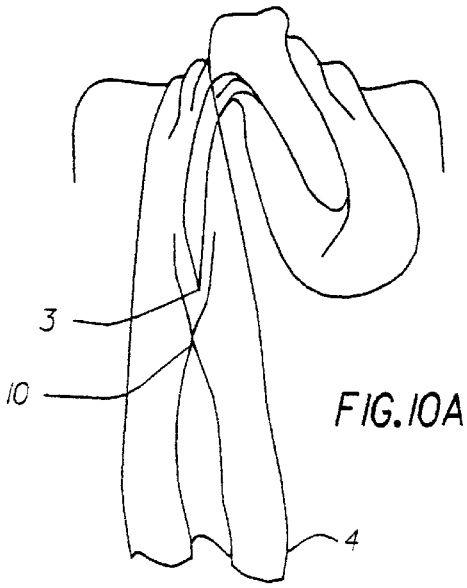
FIGS. 10*a*–10*d* are front elevational views of the right angle triangular shaped scarf shown in FIG. 2 showing how the unpleated end of the scarf is pulled through the pleat to form a decorative tie.
Figure 10B:
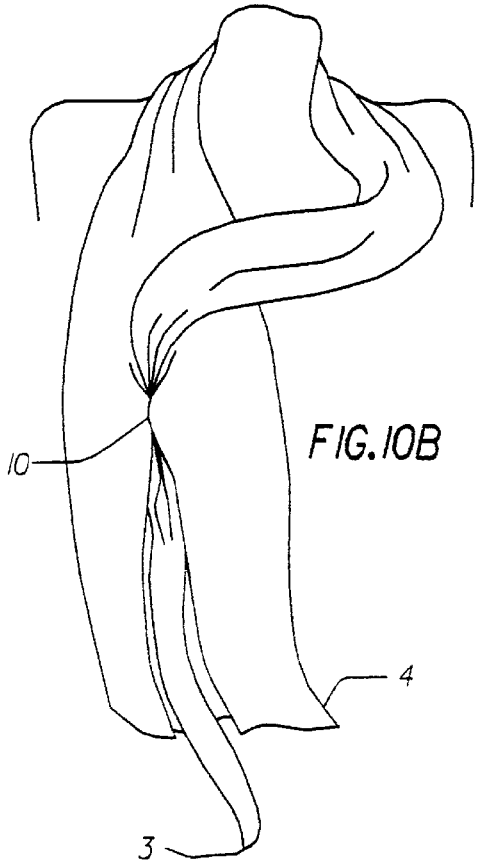
Figure 10C:
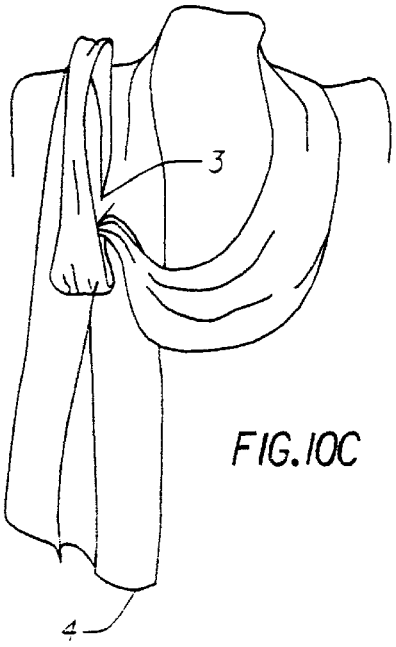
Figure 10D:
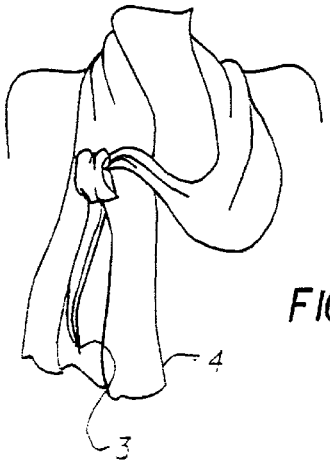

As shown in FIGS. 10*a* through 10*b*, the scarf 1 is shown being secured about the neck of user. The right angled first end 3 is shown in FIGS. 10*a* and 10*b* being pulled through the knot pleat 10 and then looped again through the knot pleat 10, as shown in FIGS. 10*c* and 10*d*, to form an elegant tied effect of fabric of varying shapes.

SUMMARY

In operation, the present invention is directed toward a scarf 1 that can have a first end 3 that is spaced apart from a second end 4, and which has a knot pleat 10 that is formed by folding the fabric and tacking a straight sewn stitch generally in the middle of the folded fabric. The knot pleat 10 is located approximately ⅕ to ⅓ of the distance from the second end 4. To secure the scarf 1 to the user, the scarf 1 is wrapped around the neck, waist or head of the user and then the first end 3 is pulled through the knot pleat 10 and then can be reinserted and repulled through the knot pleat 10 to form a tied effect. Alternatively, the present invention can include an alternate embodiment being directed toward a scarf 20 that has a rectangular shape or a scarf 30 that has a square shape. The scarfs 20 and 30 would have a knot pleat 22 and 32, respectively, that is formed along the center of the scarf approximately ⅕ to ⅓ of the distance from one end of the scarf. The unpleated end of the scarf could then be pulled through the knot pleat 22 or 32 when the scarf is being placed about and secured to the user.

It is to be understood that while certain forms of this invention have been illustrated and described, the invention is not limited thereto, except insofar as such limitations are included in the following claims.

What is claimed and described to be secured by Letters Patent is as follows:

1. A scarf comprising a piece of fabric having spaced apart first and second ends with the first end having a pleat formed in the scarf, with the pleat being formed by a sewn stitch and permitting the scarf, when worn, to be secured by the user by having the second end of the scarf pulled through the pleat thereby securing the scarf to the user.

2. The scarf as set forth in claim 1, wherein the pleat is formed approximately ⅓ of the overall length of the scarf from the first end by folding the fabric and tacking with a straight sewn stitch a machine tack that is generally applied in the middle of the folded fabric.

3. The scarf as set forth in claim 1 wherein the pleat is formed approximately ⅕ of the overall length of the scarf from the first end by folding the fabric and tacking with a straight sewn stitch a machine tack that is generally applied in the middle of the folded fabric.

4. The scarf as set forth in claim 1 wherein the scarf has a rectangular shape.

5. The scarf as set forth in claim 1 wherein the scarf has a right angle triangular shape.

6. The scarf as set forth in claim 1 wherein the scarf is square shaped and the first end is diagonally opposite to the second end of the scarf.

7. The scarf as set forth in claim 1 wherein the scarf has a tied effect.

8. A scarf comprising a piece of fabric having a rectangular shape with spaced apart first and second ends, with the first end having a pleat formed approximately ⅕ to ⅓ of the overall length of the scarf from the first end permitting the second end to be pulled through the pleat for securing the scarf to a user.

9. The scarf as set forth in claim 8 wherein the pleat is formed by folding the fabric and tacking a straight sewn stitch generally about the middle of the folded fabric.

10. A scarf comprising a piece of fabric having a square shape with spaced apart diagonally opposed first and second ends, with the first end having a pleat formed about ⅕ to ⅓ of the overall length from the the first end permitting the second end to be pulled through the pleat for securing the scarf to the user.

* * * * *

UNITED STATES PATENT AND TRADEMARK OFFICE

CERTIFICATE OF CORRECTION

PATENT NO. : 6,065,156

DATED : May 23, 2000

INVENTOR(S) : Paula C. Murphy

It is certified that error appears in the above-identified patent and that said Letters Patent are hereby corrected as shown below:

On the title page, item: (57) Abstract:
In the last line, delete "to" after" pulled" and insert therefor --through--.

Column 4, Line 55, in Claim 10, delete "the" after "from".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*